US005927499A

United States Patent [19]

Vesborg

[11] Patent Number: 5,927,499

[45] Date of Patent: Jul. 27, 1999

[54] HYDROSTATIC CONTAINERS

[75] Inventor: Steen Vesborg, Gentofte, Denmark

[73] Assignee: Colgate-Palmolive Company, New York, N.Y.

[21] Appl. No.: 09/087,186

[22] Filed: May 29, 1998

[51] Int. Cl.[6] ..... B65D 21/032

[52] U.S. Cl. ..... 206/509; 215/10; 220/666; 220/6; 220/4.27

[58] Field of Search ..... 215/6, 10; 220/666, 220/6, 4.27, 4.26, 608; 206/508, 509

[56] References Cited

U.S. PATENT DOCUMENTS

| | | | |
|---|---|---|---|
| 2,077,027 | 4/1937 | Torras | 206/508 |
| 3,301,293 | 1/1967 | Santelli | 220/666 |
| 3,397,724 | 8/1968 | Bolen . | |
| 3,485,355 | 12/1969 | Stewart . | |
| 4,301,933 | 11/1981 | Yoshino . | |
| 4,416,373 | 11/1983 | Delarosiere . | |
| 4,497,855 | 2/1985 | Agrawal . | |
| 4,775,564 | 10/1988 | Shriver et al. | 215/10 |
| 4,798,300 | 1/1989 | Ghosh et al. | 215/10 |
| 4,830,251 | 5/1989 | Conrad . | |
| 4,997,692 | 3/1991 | Yoshino . | |
| 5,119,972 | 6/1992 | Reed et al. | 206/509 |
| 5,178,276 | 1/1993 | Sheets | 206/508 |
| 5,244,106 | 9/1993 | Takacs . | |
| 5,573,129 | 11/1996 | Nagata et al. | 220/666 |
| 5,746,260 | 5/1998 | Vesborg . | |
| 5,746,339 | 5/1998 | Petre et al. . | |

FOREIGN PATENT DOCUMENTS

| | | | |
|---|---|---|---|
| 1482875 | 6/1967 | France | 215/10 |
| 2503-665 | 4/1981 | France . | |
| 2340967 | 3/1974 | Germany | 206/508 |
| 53-149264 | 12/1978 | Japan . | |
| 481787 | 3/1938 | United Kingdom | 215/10 |
| 869392 | 5/1961 | United Kingdom | 215/10 |
| 92004236 | 3/1992 | WIPO | 206/508 |

*Primary Examiner*—Stephen Castellano
*Attorney, Agent, or Firm*—Michael McGreal

[57] ABSTRACT

The invention is directed to lightweight hydrostatic containers. The containers have thin walls and other surfaces that are maintained in tension by the liquid contained in the containers. The body portion is substantially circular and has a plurality of recesses. The recesses strengthen the container and provide points where the container can axially collapse. On the lower end the container has a base with an upwardly extending inner portion. This inner portion extends upwardly at least the vertical dimension of a spout of the container. A shoulder is on an upper end of the body portion, the shoulder supporting an axial spout. The hydrostatic containers preferably are packed in cartons in double squares. The cartons have sidewalls that do not extend above the body portion of the containers. The carton bottom wall has openings in alignment with the upwardly extending inner portion of each hydrostatic container. In this way the spouts of containers in a lower carton fit into the upwardly extending inner portions of the hydrostatic containers of an upper carton.

18 Claims, 4 Drawing Sheets

HYDROSTATIC CONTAINERS

FIELD OF THE INVENTION

This invention relates to the structure of hydrostatic containers. This invention also relates to the stacking of hydrostatic containers, and the cartoning and palletizing of hydrostatic containers. This invention further relates to the filling and capping of hydrostatic containers.

BACKGROUND OF THE INVENTION

There is a continuing need for lightweight containers so as to reduce the amount of packaging materials. This is more so the case in countries where there is a tax levied on the weight of packaging. However, besides being lightweight, the containers must be able to be shipped using a minimum of carton materials and must be easily handled by the end user. Further, after use, the container should be collapsible to decrease the disposal cost. In some countries a disposal fee is levied on the volume of material that is disposed of in the trash. The state of the art of thin walled containers, and the stacking and palleting of containers generally is set out in the following patents.

In U.S. Pat. No. 5,746,339 there is disclosed a tall plastic bottle that when empty can be collapsed by axial compression. The bottle is comprised of a series of encircling recesses which contain elongated fold starters. The fold starters in the recesses aid in the collapsing of the bottle.

U.S. Pat. No. 4,997,692 discloses thin walled bottles that are blow-molded and which have a stable base. The base has an upwardly extending portion so that there only is contact of the base circumferential edge with the supporting surface. This results in a stable platform for the base. Also, the upwardly extending portion is sufficiently strong so that in any over-pressure the center portion will not extend the upwardly extending portion to a point below the base circumferential edge.

U.S. Pat. No. 5,244,106 discloses a bottle that has built into the base a cap holder. The bottom of the bottle has an upwardly extending recess and a region to grip and hold the cap. In this way the cap can be removed and placed into the cap holder in the base to prevent the cap from becoming lost.

U.S. Pat. No. 3,485,955 discloses a pallet of stacked bottles. The bottom of one bottle rests on the cap of another bottle. The bottles are shown to be stacked in six high columns. These glass bottles are not lightweight bottles, and are not hydrostatic bottles. The contents of these bottles do not contribute to the structural integrity of the bottles.

U.S. Pat. No. 4,416,373 discloses arrays of two-piece bottles that are shrink wrapped and stacked. These can be polyethylene terephthalate (PET) bottles with a supporting base. The objective here is to set forth a way to stack two-piece bottles. It is disclosed that there should be an axial contact of the closure of one bottle with the bottom of another bottle. This axial arrangement is accomplished through the use interlocking bands on each of the bottles and shrink wrapping a series of bottles together. This assures an axial arrangement of layers of the bottles.

These patents evidence the present state of art. However, they do not disclose a very useful hydrostatic container structure or how to fill, arrange and stack hydrostatic containers. The present hydrostatic containers will have a sidewall with a plurality of encircling recesses for strength and collapsibility. In addition, the base will have a recessed well symmetrical with the vertical axis of the container. Further the containers should have a maximum of contact one to the other when stacked, and should be such that each filled container is maintained in tension. No container should be in compression. Consequently, there should be an axial stacking of the containers with a contact of the walls of the recessed base of one container with the closure and shoulder wall of a lower container. A contact or close contact of the base of one container with the shoulder of a lower container will provide for the axial stacking of the containers and for a maximum of contact of one container with another container. A contacting spacer between containers also can be used for the purpose of providing a maximum surface contact of one container stacked onto another container. All of the containers in a stack will be kept in tension due to the axial arrangement and the hydrostatic loading of the containers.

BRIEF SUMMARY OF THE INVENTION

The present invention is directed to lightweight hydrostatic containers. The containers when filed with a liquid are under tension and in cartoning for shipping can support several layers of such hydrostatic containers. The hydrostatic container has a body portion that has a plurality of encircling recesses. These recesses strengthen the body portion and when empty provide points for the collapse of the body portion upon the application of a downward force. On the lower end of the body portion is a base and on the upper end of the body portion a shoulder which tapers to a spout.

The base has an outer portion with a plurality of reinforcing recesses and an upwardly extending inner portion. The upwardly extending inner portion has a depth at least the length of the spout.

The spout is axially symmetrical with the body portion with the shoulder being of a frusto-conical shape. The spout has threads on an upper portion for the attachment of a closure. Below the threads there can be an encircling projecting ledge for supporting the container during container filling and the closing of the container with an appropriate closure.

Once filled and closed the containers are under tension, the tension being applied by the container contents. The containers are filled to about 95% of their volume and preferably at least about 99% of their volume.

In stacking of the containers, the spout of a lower container fits into the upwardly extending inner portion of the base of the upper container. Preferably there is a contact of the closure of the lower container with the uppermost point of the upwardly extending inner portion of the base of the upper container and of the shoulder of the lower container with the base walls of the upper container.

In the cartoning of the containers the containers are packed in double squares. A double square has $2n^2$ containers where n is an integer of about 1 to 10. The sidewalls of the carton are of a height up to that needed to enclose the body portion of the containers. The bottom wall of the carton has openings in alignment with the upwardly extending inner portion of the base of each container. These openings are of a size to at least accept the spout of one of the containers. Preferably the openings also are of a size to accept a substantial portion of the shoulder of the lower container. In this way when the cartoned bottles are stacked, the bottles are supporting substantially all of the weight of the stacked cartons.

In addition, by the cartoning of the containers in double squares, the cartons can be stacked so that one carton fully supports another, or one carton is supported by two lower cartons. This provides an option in stacking the cartons onto a pallet of interlocking the cartons so that they do not become dislocated on the pallet during handling and transportation.

DETAILED DESCRIPTION OF THE DRAWINGS

As noted the invention is directed to hydrostatic containers and the stacking and filling of these containers. A hydrostatic container is a thin walled container that when filled has all walls under tension. No walls are under compression. A plastic such as PET which has a high tensile strength, but a lower compression strength, is useful in constructing hydrostatic containers. Consequently, it is a primary objective to have a container that when filled is under tension, and when stacked in a packing arrangement on a pallet is always in tension. These hydrostatic containers, and the stacking of these containers, is described in more detail with reference to the drawings.

Figure 1A:
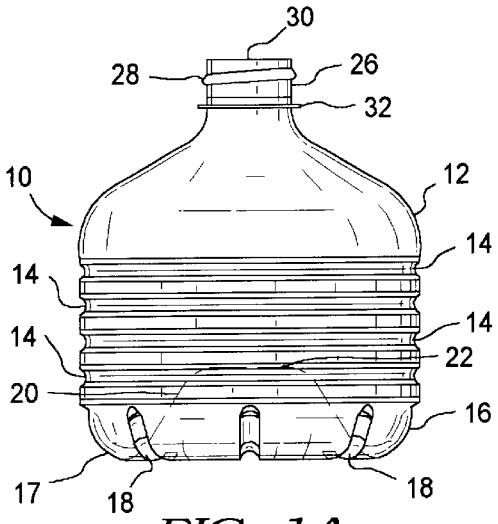
FIG. 1 is an elevational view of the hydrostatic container.
FIG. 1B is an elevational view of the hydrostatic containers stacked one on another.

FIG. 1A is an elevational view of the hydrostatic container 10. The container is comprised of sidewall 12 which has a plurality of encircling recesses 14. The container is closed on one end by base 16 which optionally has reinforcing recesses 18. The base has a peripheral wall 17 that supports the container on a flat surface. Extending upward from peripheral wall 17 is transition wall 20 which terminates at support wall 22. These walls form an axially located well in the base of the container. In a stacking arrangement support wall 22 will be contacted with the closure of another container.

On the other end of bottle 10 is shoulder 24 which terminates in spout 26. Spout 26 has threads 28 for a closure, opening 30 and a support ring 32. Wall 24 is at an angle A of about 5° to 40°, and preferably about 15° to 30°, normal to the vertical axis of the container. A wall at this angle will be of a frusto-conical shape and will provide a high surface area for contact with the base of another bottle when in a stacking arrangement.

The ratio of the height of the container to the cross-section dimension is about 0.5 to 10, and preferably about 1 to 4.

Figure 1B:
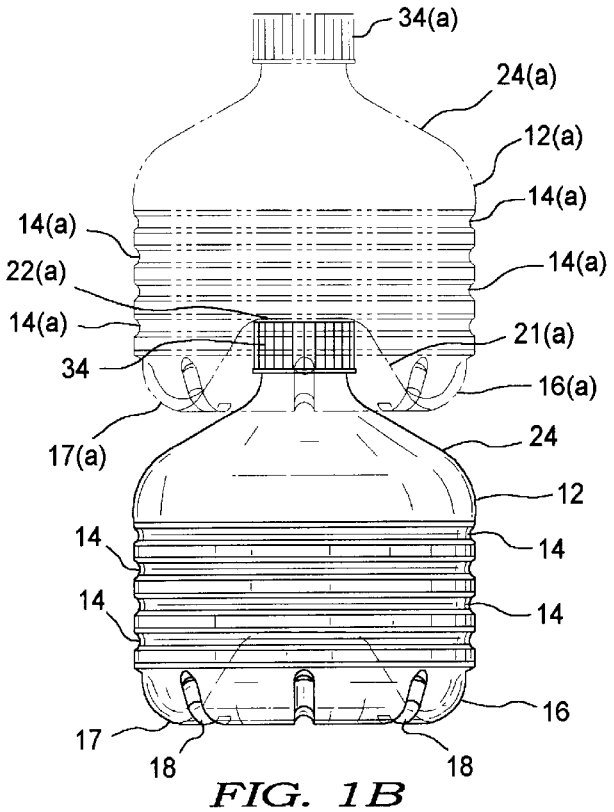

FIG. 1B shows two of the containers in a stacked arrangement. Each is a container of FIG. 1A. The lower container is the particular container of FIG. 1A with the upper container identical to the lower container. The upper container has sidewall 12(*a*) with a plurality of recesses 14(*a*). The base 16(*a*) has a peripheral circumferential section 17(*a*) with reinforcing recesses 18(*a*). Transition wall 20(*a*) terminates in support wall 22(*a*). On the other end there is shoulder 24(*a*) which terminates in closure 34(*a*). Closure 34 closes the lower container.

Figure 2:
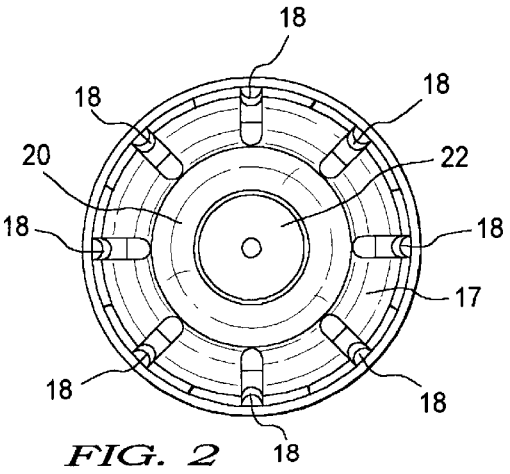
FIG. 2 is a bottom plan view of a hydrostatic container.
Figure 3:
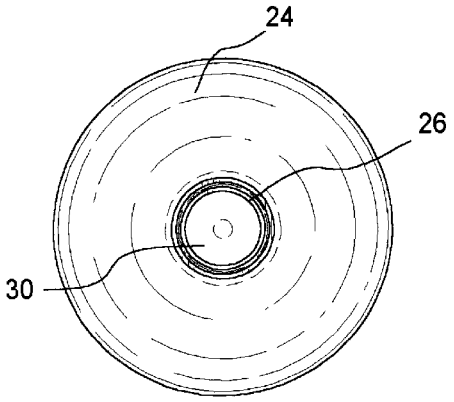
FIG. 3 is a top plan view of a hydrostatic container.

FIG. 2 is a bottom plan view of the container while FIG. 3 is a top plan view. The various bottom wall features are shown in more detail in FIG. 2 and the upper container features are shown in more detail in FIG. 3.

Figure 4:
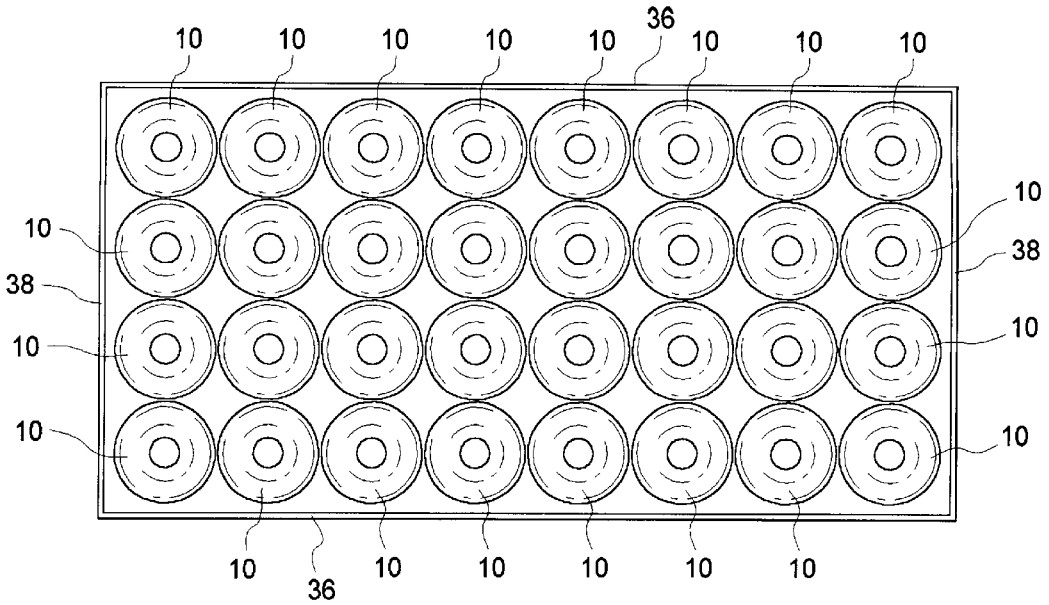
FIG. 4 is a top plan view of the hydrostatic containers cartoned in a double square.
Figure 5:
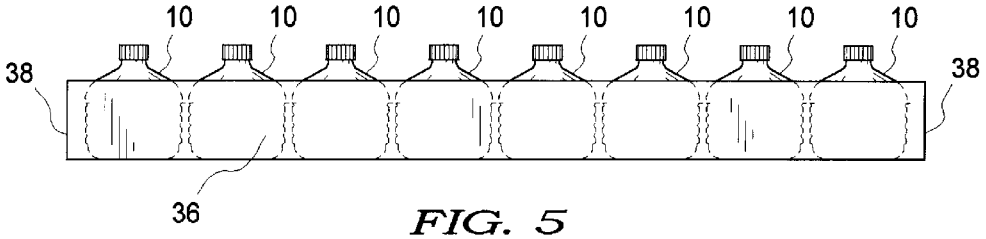
FIG. 5 is a side elevational view of the carton of FIG. 4.
Figure 7A:
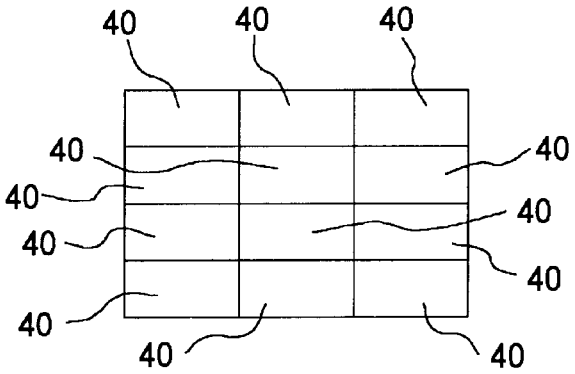
FIG. 7A is a first embodiment of stacking of cartons of FIG. 4.
Figure 7C:
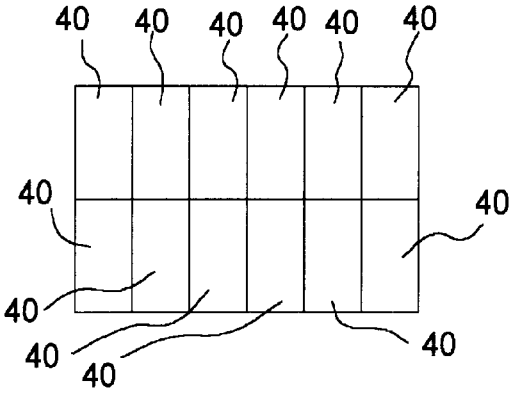
FIG. 7C is a third embodiment of stacking of cartons of FIG. 4.
Figure 7B:
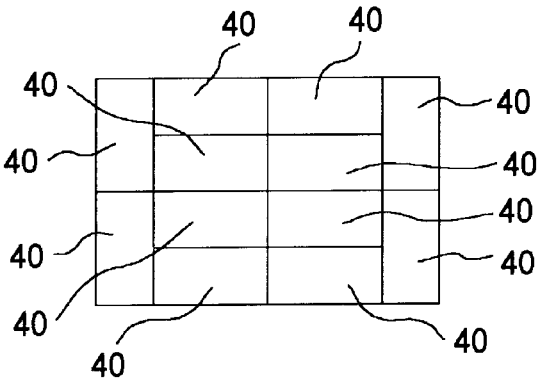
FIG. 7B is a second embodiment of stacking of cartons of FIG. 4.
Figure 7D:
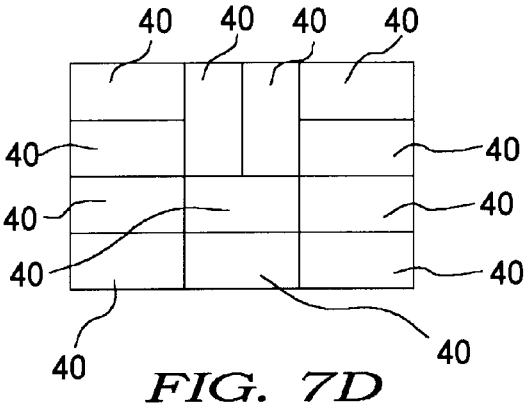
FIG. 7D is a fourth embodiment of stacking of cartons of FIG. 4.

FIG. 4 shows the containers in a carton 40 having a front and rear wall 36 and sidewalls 38. A side view of the carton is shown in FIG. 5. The carton walls enclose no more than the sidewalls of the containers. This allows interlocking as in FIG. 1B. The containers are in an array of two squares, each square here having sixteen containers. A square can have any of two or more containers but usually will have four or more containers. The containers are in this array so that they can be stacked on a pallet in one of the arrays of FIG. 7A through 7D. The cartons can be stacked with all levels of the stack the same, or preferably with a mixed stacking. A mixed stacking is where the lower layer can be that of FIG. 7A, the next layer that of FIG. 7B through 7D, the next layer any of the arrays other than that of the second layer. The objective is to get a stacked pallet that stays together during handling and transportation. By mixng the levels there is an interlocking of the cartons from layer to layer.

Figure 6:
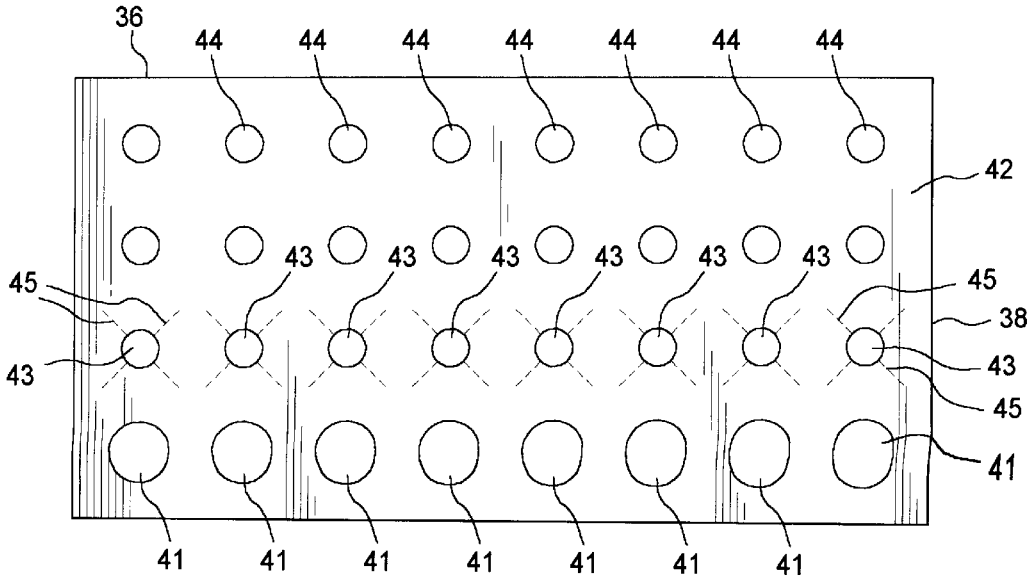
FIG. 6 is a bottom plan view of a carton for the hydrostatic containers.

FIG. 6 shows the bottom surface 42 of the carton of FIG. 4 and FIG. 6. Apertures 44 allow for the neck of the lower container to contact the base of the upper container. These apertures 44 are of a diameter to allow for this contact. Apertures 41 are of a larger diameter to allow the spout and a substantial portion of the shoulder of a lower container to extend through the aperture 41. Apertures 43 have scored or perforated lines 45 which allow the surface 42 to bend and conform to the shape of the shoulder of the lower container. These apertures 41 and 43 provide for a larger contact of the shoulder of a lower container with the base of an upper container.

In place of the use of a carton the containers can be shrink wrapped. The shrink wrap material will encircle the containers. However, the bottoms will be open so that the spout and shoulder of a lower container can contact the base of an upper container. This will allow for effective hydrostatic stacking.

Figure 8:
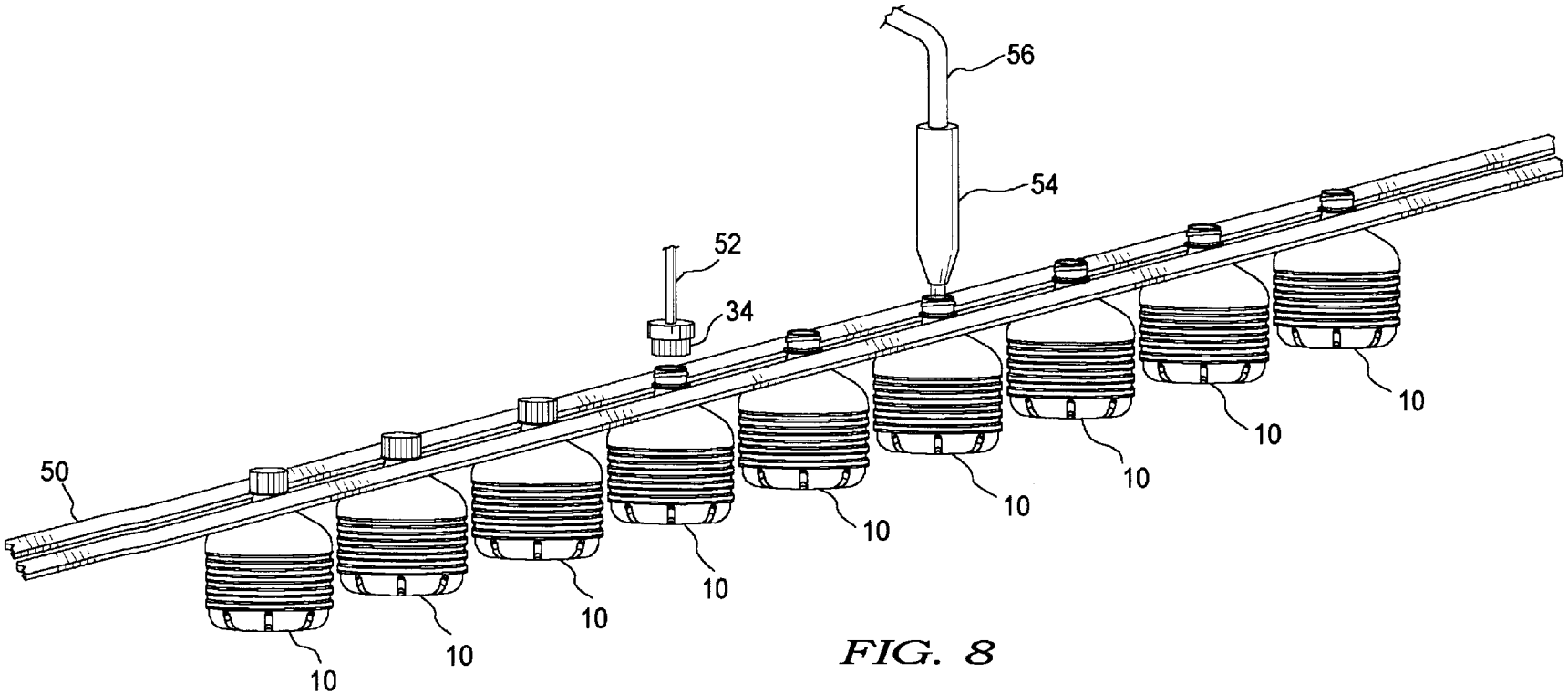
FIG. 8 is a view of the hydrostatic containers on a filling and closing line.

FIG. 8 illustrates a filling line for the hydrostatic containers. The containers move from right to left and are supported by rail 50. Rail 50 contacts support ring 32 of the container. The containers 10 move to the filler 54 which is fed with product through conduit 56. The filled containers then move to capper 52 which screws caps 34 onto each container. The container then goes to cartoning and palleting. The carton can be a tray type of carton which uses a minimum of carton material or more of a box type. A tray type has a low sidewall while a box type has a higher sidewall.

The containers are constructed of a high tensile strength material such as PET. The closures must form a tight seal with the containers but yet be readily removable. The containers are filled to about to about 95 to more than about 99% of their volume in order to have maximum hydrostatic properties.

The containers should be of a substantially circular shape. However, there can be some ovality as long as the containers in stacking will be in tension. As noted, the containers must be in tension at all times during handling and shipping.

The containers can conveniently be used in conjunction with the docking arrangement described in U.S. Pat. No. 5,746,260. This docking arrangement permits the use of very thin walled containers. Through the use of this docking arrangement the potential to spill the contents of the thin walled container during the transfer of the contained substance to the permanent container is significantly reduced. This container docking arrangement is incorporated herein by reference.

Various modifications can be made to the present invention but yet be within the present concepts. All such modifications are considered to be within the present disclosure and invention.

What is claimed is:

1. A hydrostatic container comprising a body portion having a substantially circular cross-section, said body portion having a plurality of encircling recesses, a shoulder portion extending upwardly from said body portion and tapering at an angle of about 50° to about 40° to the horizontal axis of the container to a spout, said spout extending upwardly a height dimension and being symmetrical with the vertical axis of said container, an upper part of said spout having threads thereon, a base at a lower portion of said body portion, said base having an essentially planar outer portion and an upwardly extending inner portion, said inner portion extending upwardly at least the height dimension of said spout, the body portion being axially collapsible.

2. A container as in claim 1 wherein said body portion has at least 2 recesses.

3. A container as in claim 1 wherein the ratio of the height of said container to the cross-section of said container is about 0.5 to about 10.

4. A container as in claim 1 wherein the ratio of the height of said container to the cross-section of said container is about 1 to about 4.

5. A container as in claim 1 wherein said shoulder tapers upwardly at an angle of about 15°, to about 30° to the horizontal axis of the container.

6. A container as in claim 1 where said spout has an encircling, projecting support ledge below said threads to support said container during filling and applying a closure.

7. A container set comprising at least two containers of claim 1, each of said containers having a closure, the closure on the spout of a first container contacting the inner portion of the base of a second container, a portion of the base of said second container contacting said shoulder of said first container, each of said first container and said second container being filled to about 95% to more than about 99% with a liquid.

8. A container set as in claim 7 wherein the body portion of said first container and of said second container has at least 2 recesses.

9. A container set as in claim 7 wherein the ratio of the height of said first container and of said second container to the cross-section of said first container and of said second container is about 0.5 to about 10.

10. A container set as in claim 9 wherein the ratio of the height of said first container and of said second container to the cross-section of said first container and said second container is about 1 to about 4.

11. A container set as in claim 7 wherein the shoulder of said first container and the shoulder of said second container taper upwardly at an angle of about 5° to about 40° to the horizontal axis of the container.

12. A plurality of hydrostatic containers of claim 1 in a side by side relationship in a carton, said containers in a double square relationship, said carton having side surfaces and a bottom surface partially surrounding said containers, said carton having side surfaces that extend upwardly to enclose up to the body portion of said containers, with the shoulder and spout of said containers extending upwardly above said carton, said bottom surface having an opening in alignment with the inner portion of the base of each container, said opening at least of a dimension to accept the spout of a container.

13. A plurality of hydrostatic containers as in claim 12 wherein each said opening is the bottom surface of said carton is up to the diameter of said containers.

14. A plurality of hydrostatic containers as in claim 12 wherein there is a first carton of said containers and a second carton of said containers, said first carton of said containers overlaying a second carton of said containers.

15. A plurality of hydrostatic containers as in claim 12 wherein there is a first carton of said containers, a second carton of said containers and a third carton of said containers, said first carton of said containers overlaying a part of said second carton of said containers and a third carton of said containers.

16. A plurality of hydrostatic containers as in claim 13 wherein each carton contains about $2n^2$ containers wherein n is an integer of about 1 to 10.

17. A plurality of containers as in claim 12 wherein each carton contains about 18 containers there being two squares of about 9 containers.

18. A plurality of containers as in claim 12 wherein each carton contains 8 containers there being 4 containers in each square.

* * * * *

UNITED STATES PATENT AND TRADEMARK OFFICE

CERTIFICATE OF CORRECTION

PATENT NO. : 5,927,499
DATED : July 27, 1999
INVENTOR(S) : Steen Vesborg

It is certified that error appears in the above-identified patent and that said Letters Patent is hereby corrected as shown below:

Claim 1 should be changed as follows: Col. 5, line 21, change "50°" to read -- 5° --.

Claim 5, line 2, should be changed as follows: Column 5, line 40, delete the ",".

Signed and Sealed this

Twenty-seventh Day of June, 2000

*Attest:*

*Attesting Officer*

Q. TODD DICKINSON

*Director of Patents and Trademarks*